US006554748B2

(12) United States Patent
Tollner

(10) Patent No.: US 6,554,748 B2
(45) Date of Patent: Apr. 29, 2003

(54) MULTI-PURPOSE TEETERBOARD

(76) Inventor: Bruce Tollner, 8763 Cayucos Way, San Diego, CA (US) 92129

( * ) Notice: Subject to any disclaimer, the term of this patent is extended or adjusted under 35 U.S.C. 154(b) by 60 days.

(21) Appl. No.: 09/829,293

(22) Filed: Apr. 9, 2001

(65) Prior Publication Data

US 2002/0147087 A1 Oct. 10, 2002

(51) Int. Cl.[7] ..... A63B 1/00; A63G 31/00
(52) U.S. Cl. ..... 482/51; 472/89
(58) Field of Search ..... 472/111, 89, 112, 472/120, 125; 434/194; 14/69.5; 482/148, 51

(56) References Cited

U.S. PATENT DOCUMENTS 624,832 A * 5/1899 Lowrey ..... 297/245
1,577,037 A * 3/1926 Kocher ..... 472/105
D157,939 S * 4/1950 Castelli ..... 472/112
3,663,015 A 5/1972 Bynder et al.
4,285,514 A 8/1981 Romero
5,599,235 A 2/1997 Lynberg
5,946,756 A 9/1999 Mapp
6,042,480 A 3/2000 Labelson

* cited by examiner

*Primary Examiner*—Stephen R. Crow
(74) *Attorney, Agent, or Firm*—Stetina Brunda Garred & Brucker

(57) ABSTRACT

Multi-functional practice and training apparatus for use by skateboarders, skaters, bicyclists and the like. According to a preferred embodiment, the system comprises the combination of a board with a fulcrum member that are operative to assume at least three practice modes, namely: 1) a ramp mode whereby the fulcrum is placed at one end of the board and creates an upward slope for use in riding or jumping over objects; 2) a seesaw mode whereby the board is pivotally mounted upon the fulcrum and provides a platform surface upon which the user can rock back and forth while standing or riding thereon; and 3) a rigid rail structure whereby the fulcrum defines a rail for use in "grinding."

14 Claims, 4 Drawing Sheets

MULTI-PURPOSE TEETERBOARD

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

Skateboarding, in-line skating and stunt bicycling are well-known activities enjoyed by millions of individuals worldwide. In this regard, such activities are not only fun, but are also great forms of exercise and serve to develop balance and coordination.

Such activities, however, are often very difficult to master and require tremendous amounts of time and effort before a skater or rider can become proficient. The balance and coordination necessary to master skateboarding, in-line skating and the like is typically of exceptional importance insofar as such activities can become very dangerous, and often involve tricks and stunts that could lead to serious and permanent injury if attempted by individuals lacking the requisite levels of skill. For example, skateboarding typically involves jumping over stationary objects at relatively high speeds, as well as gliding across rigid surfaces, such as cement curbs and the like and referred to as "grinding." Skateboarding, in-line skating, and stunt bicycling also typically involve jumping off ramps and the like to thus become "airborne."

While safety equipment such as helmets, elbow pads, and knee pads, can offer protection against falls and accidents, there is still lacking any method by which a skateboarder or skater can practice his or her skills or otherwise become proficient in mastering the basic maneuvers required for such activities. In this regard, except for a few isolated areas where skateboard parks and the like are available, skateboarders, skaters and the like must typically resort to practicing in parking lots, neighborhoods and city streets, which not only cause a tremendous amount of nuisance to resident and business owners, but can also cause substantial property damage. Practicing in such areas can also increase the number and risk of accidents related to such activities by increasing the possibility a given skateboarder or skater will run into or be hit by a vehicle or other stationary or moving object (e.g., lampposts, mailboxes, pedestrians, other skateboarders, etc.). Indeed, the nuisance associated with skateboarding and skating has caused a number of communities to pass laws banning such activities. Furthermore, many businesses and residents have placed physical barriers, such as caps and mounts bored into concrete, which prevent skateboarders from grinding or otherwise practicing thereon.

Even to the extent skateboard parks and the like offer a place where skateboarders and skaters can attempt to practice their skills, such facilities are few in number and typically overcrowded. There is also a substantial difficulty for most skateboarders and skaters, which are typically adolescents that are unable to drive, to access such facilities.

Accordingly, there is a substantial need in the art for a system by which a skateboarder, skater or bicyclist can easily and readily access and practice a variety of maneuvers on-site. There is a further need for such a system that is versatile and operative to assume different configurations to thus enable a variety of skills to be practiced. Still further, there is a need in the art for such a system that is space-efficient, exceptionally durable, easy to utilize, inexpensive to manufacture, and readily capable of being used with virtually all types of skateboards, skates, stunt/mountain bikes, scooters, and the like.

BRIEF SUMMARY OF THE INVENTION

The present invention specifically addresses and alleviates the above-identified deficiencies in the art. In this regard, the present invention is directed to a system for training and practicing skateboarding, skating and stunt/off-road bicycling skills. The present invention may be used for other wheeled vehicles, such as scooters and the like.

According to the preferred embodiment. The system comprises the combination of a flat board/platform member supported by a stationary fulcrum. The platform defines a first upper surface upon which the vehicle can ride across, and an underside portion having at least one and preferably two socket members affixed thereto. The socket members are designed to engage with the fulcrum, and preferably include a first socket member disposed centrally underneath the board and across the width thereof, and a second socket member extending across the width of the board underneath a respective end thereof. The fulcrum member preferably comprises the combination of a base member with an upwardly extending ball element engageable with a respective one of the sockets formed on the underneath portion of the board platform such that when interconnected to one another, a ball and socket joint is formed. It is contemplated, however, that alternative board and fulcrum arrangements may be utilized in the practice of the present invention.

The arrangement between the board and fulcrum are such that the system of the present invention may take a variety of modes to thus enable a variety of skills to be practiced. In this respect, it is contemplated that the systems of the present invention may take at least three modes, namely, a first mode whereby the board and fulcrum serve to define a ramp member to thus enable skateboarders, riders and the like to practice jumps and to leap over objects. To achieve that end, the fulcrum is attachable to the socket disposed upon a respective end of the board. In a second mode, the board and fulcrum are interconnected to one another via the centrally disposed socket to thus enable the board to see-saw back and forth. In this regard, the fulcrum member engages with the centrally-disposed socket to thus enable the board to see-saw back and forth while the rider stands thereupon. In a third configuration, the board may be rigidly affixed to the fulcrum along the centrally disposed socket thereof to define a rigid t-shape. In such configuration, the platform surface can serve as either an object for skateboarders and skaters to jump over or, alternatively, provide a ridge-like surface to enable skateboarders to practice grinding. In an alternative configuration, the fulcrum itself may be utilized for grinding. In this latter configuration, the fulcrum may be formed as an elongate member defined by a base and upwardly extending ball member. Preferably, such elongate fulcrum may be configured such that the upwardly extending ball member may be set at an incline relative level ground to thus enable skateboarders to practice grinding on inclines.

In all embodiments of the present invention, the system may be fabricated from exceptionally durable materials that can withstand vigorous impact, including durable plastics, metal, wood and the like, as well as combinations thereof. It is further contemplated that the fulcrum component may include a variable height adjustment mechanism to thus enable the board/platform to be selectively set at a desired height for a given mode.

The present invention thus provides a multi-purpose system for facilitating the training and practice for skateboarders, skaters, bicyclist and the like that can easily and readily be utilized to practice a wide variety of skills.

The present invention further provides a system that is operative to function in at least three (3) different modes, namely, a ramp, a see-saw, and a grinding rail surface to thus enable multiple skills to be practice by skateboarders.

The present invention further provides a system that is of simple construction, inexpensive to manufacture, easy to use, and may be utilized for a wide variety of wheeled vehicles, including but not limited to skateboards, in-line skates, bicycles, scooters, and the like.

The present invention still further provides a system that enables skateboarders, skaters, bicyclists, and the like to practice skills to develop balance and coordination that does not require such individuals to utilize private or public land, cause nuisance to business owners or home owners, does not violate most city ordinances, does not require the use of a skateboard park facility, and can be utilized virtually everywhere.

BRIEF DESCRIPTION OF THE DRAWINGS

These as well as other features of the present invention will become more apparent upon reference to the drawings wherein.

DETAILED DESCRIPTION OF THE INVENTION

The detailed description set forth below is intended as a description of the presently preferred embodiment of the invention, and is not intended to represent the only form in which the present invention may be constructed or utilized. The description sets forth the functions and sequences of steps for constructing and operating the invention. It is to be understood, however, that the same or equivalent functions and sequences may be accomplished by different embodiments and that they are also intended to be encompassed within the scope of the invention.

Figure 1:
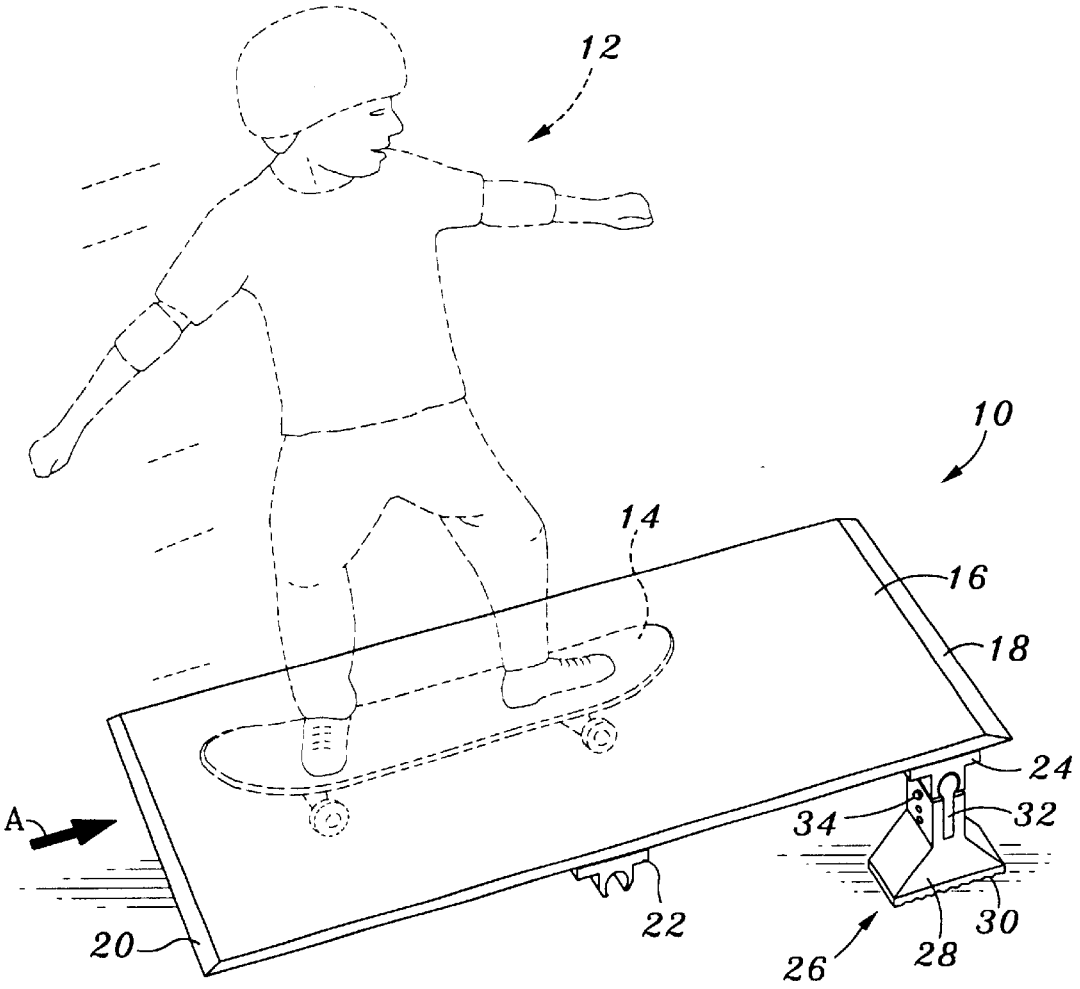
FIG. 1 is a perspective view of a multi-purpose skateboard, skate and bicycle training system according to the present invention assuming a first ramp configuration, and further depicting a skateboarder on a skateboard thereon, the later being depicted in phantom.

Referring now to the figures, and initially to FIG. 1, there is perspectively illustrated a system 10 for facilitating the development of skateboarding skills of a skateboarder 12 riding on a skateboard 14 thereon. In this respect, the system 10 is specifically designed to enable a skateboarder 12 to practice a variety of maneuvers and is operative to assume multiple modes and configurations that can enable the skateboarder 12 to become proficient in performing a variety of skateboarding skills, such as jumping off ramps, developing balance, and "grinding". It should be recognized at the outset, however, that although primarily referenced herein for use in the development of skateboarding skills, the system 10 of the present invention may likewise be utilized with a wide variety of wheeled vehicles, especially roller skates, and in particular in-line skates, stunt/mountain bicycles, scooters, and the like. Accordingly, it should be understood the outset that the multi-functional system 10 of the present invention can be utilized for any of a wide variety of training purposes.

As illustrated in FIG. 1, the system 10 is shown assuming a first ramp configuration. As shown, the system 10 comprises a first board/platform member 16 which defines an upper surface upon which the skateboarder 12 on skateboard 14 can ride across in the direction indicated by the letter A. To facilitate the ability of the skateboard 14 to roll from the ground upon the board 16, the board 16 will preferably have beveled edges 18, 20 to ensure a smooth transition. As will be recognized by those skilled in the art, the board 16 may be fabricated from any of a wide variety of durable materials, including but not limited to, hardened plastic, wood, steel and the like.

To enable the board 16 to assume a variety of configurations, and in particular including the ramp configuration shown, there is formed on the underside thereof socket members 22, 24 rigidly affixed thereon via bolts 36 (although the same may alternatively be integrally formed to board B. As illustrated, and as discussed more fully below, the board 16 preferably includes at least one, and preferably two of such socket members 22, 24 to enable the board 16 to assume various configurations. Preferably, a first socket 22 is centrally disposed underneath the board 16, whereas the second socket 24 is disposed underneath the board 16 at a respective end thereof. To enable the system 10 to assume the ramp configuration shown, the system includes a fulcrum member 26 that engages with a respective socket, and in this case 24, formed at the end of the board 16. Preferably, such fulcrum 26 is defined by the combination of a base 28, which preferably includes a texturized foot 30 and upwardly extending ball member 32, the latter being affixed to the base 28 via bolts 34.

Figure 2:
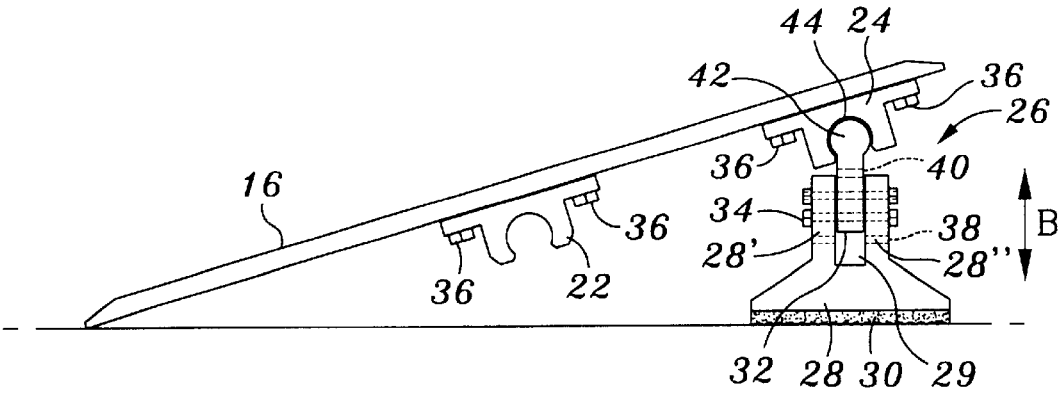
FIG. 2 is side-view of the system depicted in FIG. 1.

The ramp-like configuration of the system 10 of the present invention is better depicted in FIG. 2 which illustrates the board 16 being maintained in an inclined configuration relative the ground. As illustrated, the board member 16 is propped up via the engagement between the fulcrum 26 and socket 24. In this regard, the ball member 32, and more particularly the ball portion 42 thereof engages the socket member 24 via the socket 44 defined thereby. In order to provide the user with means to adjust the height of the ramp, as illustrated by the letter B, the ball member 32 and base member 28 are provided with apertures 40, 38 respectively formed thereon that are designed to align with one another so that bolts 34 can extend therethrough to rigidly maintain the ball member 32 in the upward orientation as shown. In this respect, the base 28 may include opposed, upwardly extending members 28', 28' formed in generally parallel relation to thus sandwich the ball member 32 therebetween when apertures 40, 28 align with one another to define a pathway through which bolt 34 may extend. When so configured, the ball and socket joint formed between upwardly extending ball portion 42 and socket 24, by virtue of the rigid attachment of the socket 24 to board 16 via bolts 36, will thus maintain the board 16 and the desired inclined configuration. While in such configuration, it will be understood that the skateboarders may utilize the board and fulcrum to practice jumping and landing skills as is frequently encountered in skateboarding.

Figure 3:
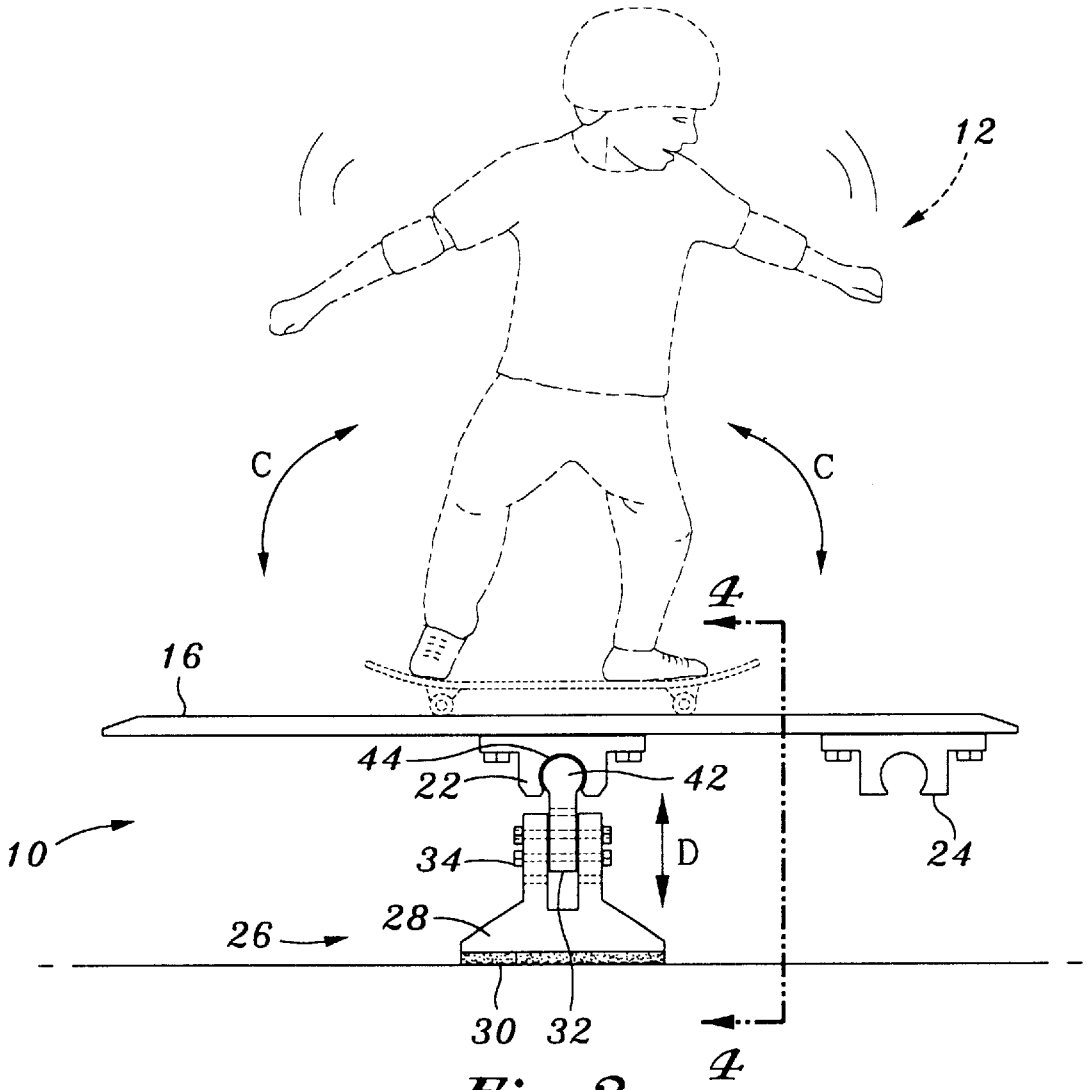
FIG. 3 is a side-view of the system of FIG. 1 shown assuming a second see-saw configuration and also depicting this skateboarder on skateboard thereon.

Referring now to FIG. 3, there is shown the system 10 assuming a second see-saw mode for developing the balance and coordination of the skateboarder 12. As illustrated, the board 16 is interconnected to fulcrum 26 via central socket 22. In this regard, ball portion 42 of ball member 32 is received within socket 44 to thus enable the board 16 to pivot or seesaw the direction indicated by the letter C. When the skateboarder 12 is standing thereon, he or she can rock back and forth to thus develop balance and coordination. To the extent desired to produce a more extreme rocking or see-saw motion, the height of ball member 32 can be adjusted in the direction indicated by the letter D by selectively interconnecting the ball member 32 to base 28 via bolts 34.

Figure 4:
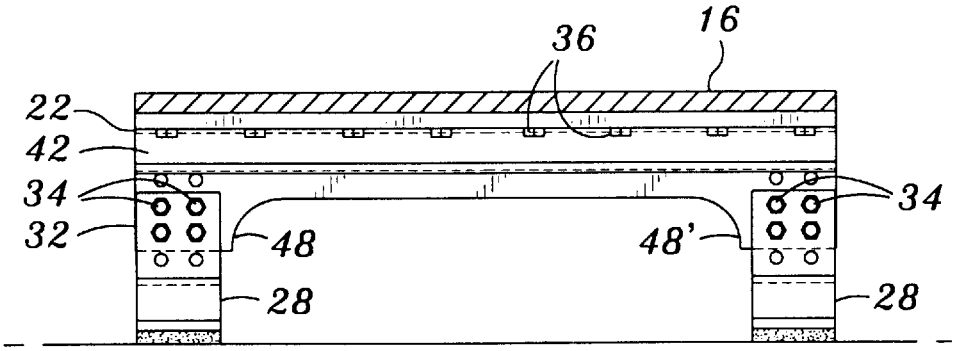
FIG. 4 is a view taken along the line 4—4 FIG. 3.

To selectively cause the system 10 to assume such seesaw configuration, there is shown in FIG. 4 the preferred embodiment by which the same may be achieved. As illustrated, two fulcrums 26 are deployed at opposed ends (i.e., width-wise) of the board 16. The ball member 32 may be formed as an elongate bar having downwardly extending leg portions 48, 48' that engage with both respective base members 28. Such ball member further includes an elongate ball portion 42 that extends along the width of the board 16 and is received within socket 22 fastened thereto via bolts 36. Advantageously, such configuration provides secure interconnection between the board 16 and fulcrum 26 while at the same time providing an optimal pivotal motion necessary to promote balance and coordination.

Figure 5:
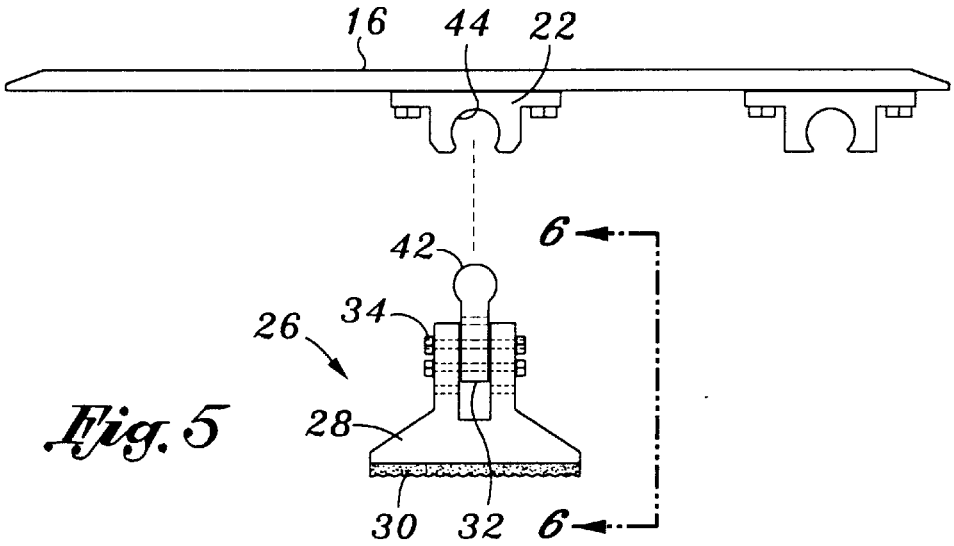
FIG. 5 is a side exploded view of the system depicted in FIG. 1 showing the relationship between the board portion and fulcrum portion thereof.
Figure 6:
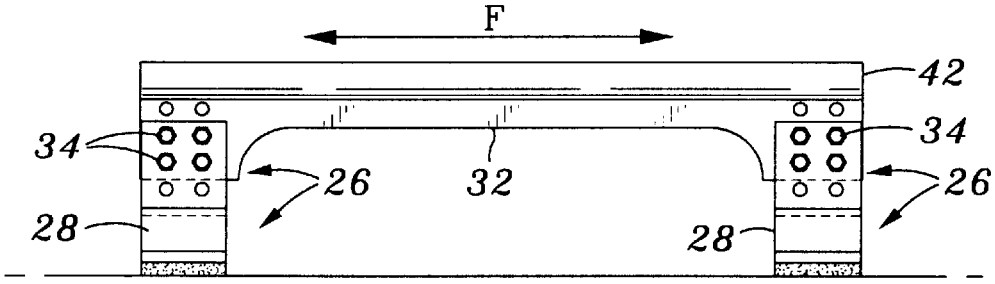
FIG. 6 is a view taken along line 6—6 of FIG. 5.

Referring now to FIG. 5, there is shown yet another mode by which the system 10 of the present invention may operatively form. As illustrated, board 16 may be detached and removed from fulcrum 26 by merely lifting the board 16 therefrom. Due to the loose interconnection between the ball and socket joint formed between the cooperation of socket 22 and ball member 32, the board 16 will easily lift therefrom. When so removed, as illustrated in FIG. 6, there will thus be provided in upwardly extending ball portion 42 of ball member 32. Such elongate ball portion 42 will thus provide a surface for "grinding" thereacross, as indicated by the letter F. In this respect, due to the rigid attachment between ball member 32 and base 28 of fulcrum 26, ball portion 42 will essentially provide a rigid bar-like structure across which skateboarders and skaters can glide. Such skill, well-known to skateboarders and the like, has hereto for been extremely difficult to practice insofar as such motion is typically attempted on cement curbs or metal handrails which cannot only be destructive to property, but can substantially increase the risk that the skateboarder or skater will become injured to the extent they fall off from structure.

Figure 7:
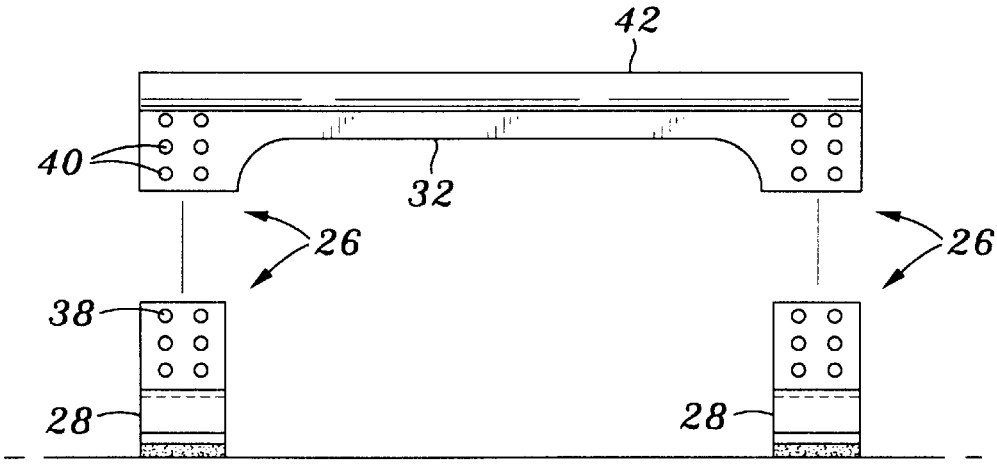
FIG. 7 is an exploded view of the fulcrum depicted in FIG. 6.

The configuration of FIG. 6 may further be adjusted from a height standpoint due to the interconnectability between ball member 32 and base members 28 insofar as the respective apertures formed thereon can be aligned such that the ball member 32 and more specifically the ball portion 42 thereof extends upwardly to a desired height, as reflected in the exploded view of FIG. 7.

Figure 8:
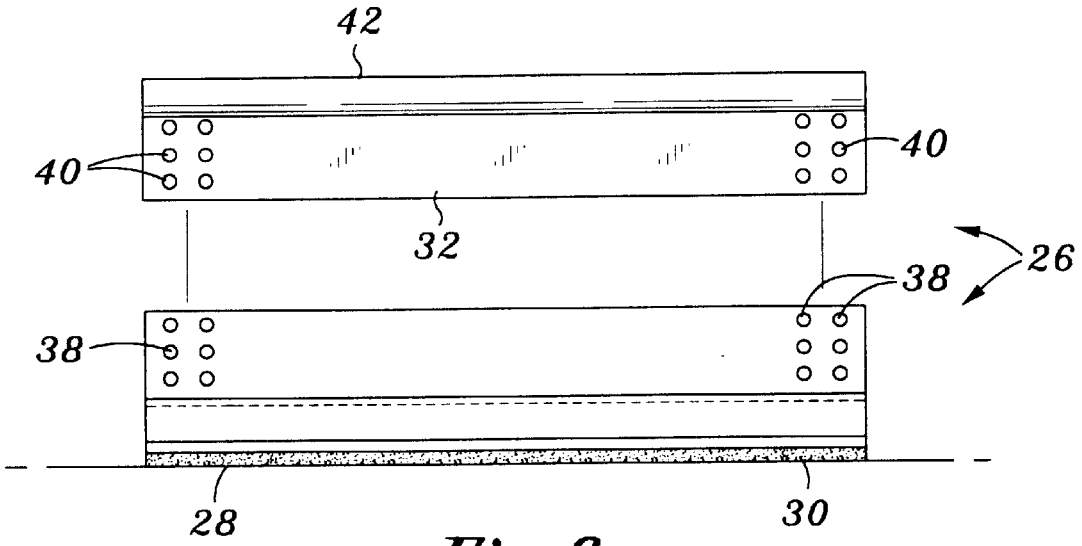
FIG. 8 is an exploded view of a fulcrum constructed in accordance of a second embodiment.
Figure 9:
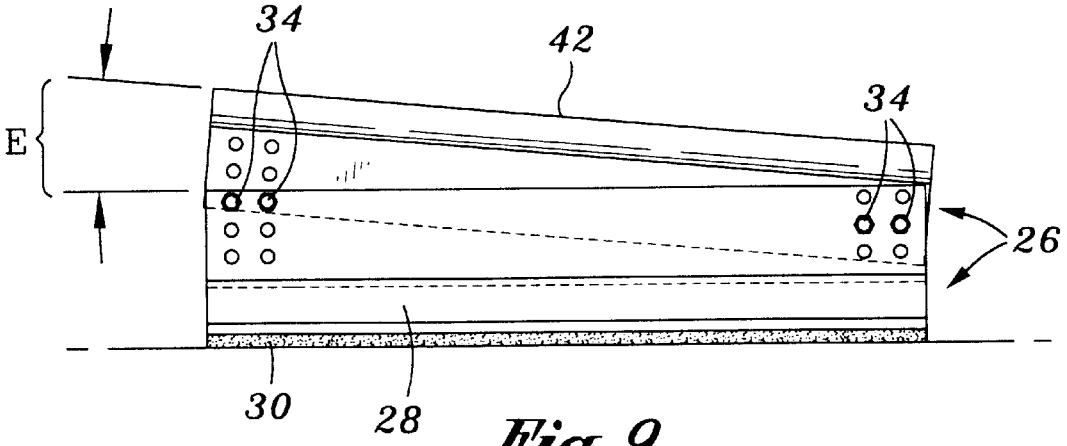
FIG. 9 is a frontal view of the fulcrum body depicted in FIG. 8 set at an incline relative level ground.

Referring now to FIGS. 8 and 9, and initially to FIG. 8, it is shown an alternative embodiment of the fulcrum 26 as utilized in the system of the present invention. In this respect, such embodiment utilizes the combination of both an elongate base member 28 and elongate ball member 32, as opposed to separate base members 28 as depicted in FIGS. 6 and 7. As per the earlier embodiment, however, the same components interconnect to one another insofar as respective apertures 38, 40 formed respectively thereon are designed to align with one another so that such elements 28, 30 can be rigidly attached to one another in the aforementioned manner.

Such configuration, however, allows for an easy adjustment to enable the ball member 32, and more particularly the ball portion 42 thereof, to assume an incline configuration depicted by the letter E. In this respect, by aligning a first set apertures 38, 40 on a first end of the base 28 and ball member 32 and a dissimilar set of apertures on the respective other end, in the manner shown in FIG. 9, thus creates an incline on ball portion 42, which can be exceptionally useful in grinding on sloping surfaces, as is frequently encountered in skateboarding, skating and the like. It should be recognized, however, that although advantageous with the embodiment depicted in FIGS. 8 and 9, the same incline configuration can be achieved by the embodiment depicted in FIGS. 6 and 7 by aligning and interconnecting apertures 38 formed on base member 28 with pairs of apertures 40 formed upon ball member 32.

Although the invention has been described here and with specific reference to a presently preferred embodiment thereof, it would be appreciated by those skilled in the art that various modifications, deletions, and alterations, maybe made to such preferred embodiment without departing from the spirit and scope of the invention. Accordingly, it is intended that all reasonably foreseeable additions, modification, deletions, and alterations be included within the scope of the invention as defined in the following claims. For example, it is contemplated that the system of the present invention may be utilized, particularly when the same assumes the mode depicted in FIGS. 6–9, to merely serve as an obstacle over which a skateboarder, skater, or bicyclist can jump over. It should further be recognized that although depicted in here with a particular fulcrum embodiment, it will be recognized that any of a variety of fulcrum mechanism may be utilized that can enable the system of the present invention to operate in its multi-mode function.

What is claimed is:

1. A multi-functional training apparatus for developing skills on wheeled vehicles, the apparatus comprising:

a) a board member having a bottom surface and an upper platform surface having a geometrically continuous profile for accommodating a wheeled vehicle thereupon, b) a fulcrum member detachably interconnectable to said board member; and c) wherein said board member and said fulcrum member are operatively transitional between:

i) a first ramp mode whereby said fulcrum member engages with the bottom surface of said board member to define a jumping ramp sized and configured to receive said wheeled vehicle thereacross and launch said wheeled vehicle therefrom;

ii) a seesaw mode whereby said fulcrum member engages said bottom surface of said board member such that said board member is operative to move pivotally relative said fulcrum member; and iii) a stationary fulcrum mode whereby the board member is removed from the fulcrum member and the fulcrum member defines an elongate, upwardly-ascending rail member defining a geometrically continuous side surface sized and configured to slidably receive said wheeled vehicle thereacross.

2. The apparatus of claim 1 wherein said board member has at least one fulcrum-receiving member formed upon said bottom surface thereof for detachably engaging with said fulcrum member.

3. The apparatus of claim 2 wherein:

a) said fulcrum-receiving member comprises a socket member;

b) said fulcrum member comprises a base member having an upwardly-extending ball member formed thereon; and c) wherein said socket member and said ball member are interconnectable to one another to form a ball and socket joint.

4. The apparatus of claim 2 wherein said board member includes at least two fulcrum-receiving members formed on said bottom surface thereof.

5. The apparatus of claim 4 wherein a respective one of said fulcrum-receiving members is disposed upon a center portion of said bottom surface of said board member and a respective second fulcrum-receiving member is formed upon a respective end of said bottom surface of said board member.

6. The apparatus of claim 5 wherein said at least two fulcrum-receiving members comprise elongate first and second socket members, wherein a respective one of said first and second socket members extends along a width of said board member at said center portion thereof and another of said first and second socket members extends along a width of said board member at a respective end thereof, said first and second socket members being formed in substantially parallel relation to one another.

7. The apparatus of claim 6 wherein said first and second socket members are integrally formed with said board member.

8. The apparatus of claim 7 wherein said first and second socket members are fastened to said board member.

9. The system of claim 1 wherein said fulcrum member further includes a height adjustment mechanism.

10. The system of claim 3 where said ball member is detachably fastenable to said base and operative to assume a selected height.

11. A multi-functional training apparatus for developing skateboarding, skating and bicycling skills comprising:

a) a board member having a bottom surface and an upper platform surface, said board member further having at least two fulcrum-receiving members formed upon said bottom surface thereof, a respective one of said fulcrum-receiving members being disposed upon a center portion of said bottom surface of said board member and a respective second fulcrum-receiving member is formed upon a respective end of said bottom surface of said board member;

b) a fulcrum member detachably interconnectable to said board member; and c) wherein said board member and said fulcrum member are operatively transitional between:

i) a first ramp mode whereby said fulcrum member engages with the bottom surface of said board member to define a ramp;

ii) a seesaw mode whereby said fulcrum member engages said bottom surface of said board member such that said board member is operative to move pivotally relative said fulcrum member; and iii) a stationary fulcrum mode whereby the board member is removed from the fulcrum member and the fulcrum member defines an elongate, upwardly-ascending rail member defining a side surface upon which objects can slide across.

12. The apparatus of claim 11 wherein said at least two fulcrum-receiving members comprise elongate first and second socket members, wherein a respective one of said first and second socket members extends along a width of said board member at said center portion thereof and another of said first and second socket members extends along a width of said board member at a respective end thereof, said first and second socket members being formed in substantially parallel relation to one another.

13. The apparatus of claim 12 wherein said first and second socket members are integrally formed with said board member.

14. The apparatus of claim 13 wherein said first and second socket members are fastened to said board member.

* * * * *